US005666626A

United States Patent [19]

Takizawa et al.

[11] Patent Number: 5,666,626

[45] Date of Patent: Sep. 9, 1997

[54] APPARATUS FOR DEVELOPING ELECTROSTATIC LATENT IMAGES USING DEVELOPING ROLLER HAVING SPECIFIC IONIZATION POTENTIAL

[75] Inventors: Yoshio Takizawa, Futsusa; Koji Takagi; Hiroshi Kaneda, both of Kodaira; Takahiro Kawagoe, Tokorozawa, all of Japan

[73] Assignee: Bridgestone Corporation, Tokyo, Japan

[21] Appl. No.: 611,164

[22] Filed: Mar. 5, 1996

[30] Foreign Application Priority Data

Mar. 10, 1995 [JP] Japan ..... 7-079687
Nov. 7, 1995 [JP] Japan ..... 7-313510

[51] Int. Cl.[6] ..... G03G 15/08

[52] U.S. Cl. ..... 399/286

[58] Field of Search ..... 355/259, 261; 118/651, 661; 399/279, 286

[56] References Cited

U.S. PATENT DOCUMENTS 5,057,871 10/1991 Hirose et al. ..... 355/259
5,175,586 12/1992 Goseki et al. ..... 355/259
5,274,426 12/1993 Goseki et al. ..... 355/259

FOREIGN PATENT DOCUMENTS 4-131881 5/1992 Japan .
4-191752 7/1992 Japan .

*Primary Examiner*—Robert Beatty
*Attorney, Agent, or Firm*—Sughrue, Mion, Zinn, Macpeak & Seas

[57] ABSTRACT

A developing roller (1) having a thin layer of a developer (4) carried thereon and a drum (3) bearing an electrostatic latent image on its surface are rotated in close relationship, thereby feeding the developer (4) to the surface of the drum (3) for visualizing the electrostatic latent image thereon. The ionization potential of the developing roller (1) surface is adjusted to be below the ionization potential of the developer (4) surface when the developer is charged negative and above the ionization potential of the developer (4) surface when the developer is charged positive. The developer has an ionization potential of 4.5–5.5 eV. When using negatively charged developer, the development roller should preferably contain a lubricant or non-ionic surfactant and should preferably be made of a polyurethane containing a polyisocyanate so as to obtain the desired ionization potential.

8 Claims, 1 Drawing Sheet

APPARATUS FOR DEVELOPING ELECTROSTATIC LATENT IMAGES USING DEVELOPING ROLLER HAVING SPECIFIC IONIZATION POTENTIAL

BACKGROUND OF THE INVENTION

1. Field of the Invention

This invention relates to a method and apparatus for developing electrostatic latent images in electrophotographic and electrostatic recording machines such as copiers and printers.

2. Prior Art

In electrophotographic and electrostatic recording machines such as copiers and printers, visible images are formed by causing a latent image-bearing body such as a photoconductor drum to bear an electrostatic latent image and feeding a developer onto the latent image-bearing body for visualizing the latent image. From the standpoints of size reduction of the development unit, cost reduction and reliability, it is advantageous to use a one-component developer in the development step. The one-component developer is often called a toner.

A variety of development methods are known in the prior art for visualizing electrostatic latent images by feeding a toner to a latent image-bearing body such as a photoconductor drum for adhering the toner to the latent image on the drum. Included are a powder cloud method of spraying toner particles, an impression developing method of feeding toner particles in direct contact with the latent image-bearing surface of a photoconductor drum, a jumping development method of charging toner particles and effecting development under the impetus of an electric field of a latent image without contact with the latent image-bearing surface of a photoconductor drum, and a magnetite development method of delivering a magnetic conductive toner in contact with the latent image-bearing surface of a photoconductor drum.

Referring to FIG. 1, the impression developing method is briefly described. A developing roller 1 having a conductive elastomer layer is placed between atoner feed roller 2 for feeding a toner 4 and a photoconductor drum 3 having an electrostatic latent image borne thereon. The developing roller 1 is in contact with or slightly spaced apart from the photoconductor drum 3. Upon rotation of the developing roller 1, photoconductor drum 3, and toner feed roller 2 in the directions shown by arrows, the toner 4 is fed from the feed roller 2 onto the surface of the developing roller 1 and regulated into a uniform thin layer by a doctor blade 5. The thin layer of toner is then delivered from the developing roller 1 to the photoconductor drum 3 to adhere to the latent image whereby the latent image is developed into a visible toner image. The toner image is finally transferred from the photoconductor drum 5 to a record medium 7, typically paper in a transfer section 6. Also included is a cleaning section 8 having a cleaning blade 9 for scraping off the toner left on the photoconductor drum 3 after the transfer step.

In reversal development as used in printers, the toner must be charged to the same polarity as the charge on the latent image-bearing drum. In general, organic photoconductors are used as the latent image-bearing drum. Since the organic photoconductors have a negative charge potential, the toner must also be charged negative. Where positive charging photoconductors such as amorphous silicon photoconductors are used, the toner must be charged positive since the charge potential of these photoconductors is positive. Since charging of the toner largely depends on triboelectric charging with the developing roller surface, the compatibility between the toner and the developing roller must be controlled by a proper design of the materials of both the toner and the developing roller. Incompatibility between the toner and the developing roller results in initial images suffering from fog and image memory, especially in a hot, high humidity environment or cold, low humidity environment. Even when the initial image is satisfactory, the incompatibility will invite problems such as lowering of image density and charge quantity as image printing is repeated.

One common approach in the prior art for controlling the compatibility between a toner and a developing roller is as the toner side control by blending a charge control agent therein in accordance with the materials of a layer-forming blade and a developing roller and as the developing roller side control by selecting a material therefor on the basis of triboelectric charging sequence.

These compatibility control techniques, however, have the following problems. With respect to the developing roller side control, the control relying solely on the triboelectric charging sequence is insufficient. In the case of conductive elastomeric rollers, conductive powder and salts are added for imparting conductivity, but can alter charging properties. Also, in the case of elastomeric rollers, a choice of material is limited in order to avoid contamination of the photoconductor. With respect to the toner side control, the additive (charge control agent) does not exert a quantitative effect and toner formulation matching with the blade and developing roller becomes a time-consuming procedure. The extent of control is limited partially because of CCA contamination.

Also in the prior art, for a proper combination of a developing roller and a toner, it is impossible to evaluate their compatibility without undue experimentation because there are available no compatibility judging methods other than actual image printing and measurement of toner's charge quantity.

SUMMARY OF THE INVENTION

An object of the invention is to provide an electrostatic latent image development method and apparatus which enable simple control of the compatibility between a toner and a developing roller and ensure long-term reproduction of a satisfactory image without defects such as fogging and image memory.

The present invention is directed to a process for developing an electrostatic latent image using a developing roller having a conductive layer formed around a highly conductive shaft and a drum bearing an electrostatic latent image on its surface. The developing roller is caused to carry a developer to form a thin layer of the developer, and the developer is electrically charged negative or positive. The developer-carrying developing roller and the latent image-bearing drum are rotated in mutual contact or closely spaced relationship, thereby delivering the charged developer to the surface of the drum to visualize the electrostatic latent image on the drum surface. The inventors have found that the compatibility between the developer and the development roll can be readily controlled if the compatibility can be evaluated in terms of the ionization potential at the surface of the both. More specifically, for development, the ionization potential of the developing roller at its surface is adjusted to be not higher than the ionization potential of the developer at its surface when the developer is charged negative, but not lower than the ionization potential of the developer at its surface when the developer is charged positive. This adjustment ensures long-term reproduction of a satisfactory image without defects such as fogging and image memory.

In a first aspect, the present invention provides a method for developing an electrostatic latent image using a developing roller having a conductive layer formed around a highly conductive shaft and a drum bearing an electrostatic latent image on its surface, the method comprising the steps of causing the developing roller to carry a negative chargeable developer to form a thin layer of the developer, electrically charging the developer negative, and rotating the developer-carrying developing roller and the latent image-bearing drum in mutual contact or closely spaced relationship, thereby feeding the negative charged developer to the surface of the drum to visualize the electrostatic latent image on the drum surface. The developing roller on its surface has an ionization potential and the developer on its surface has an ionization potential. According to the feature of the invention, the roller's ionization potential is adjusted to be not higher than the developer's ionization potential.

In a second aspect, the present invention provides a method for developing an electrostatic latent image using a developing roller and an electrostatic latent image-bearing drum, both as defined above. The method comprises the steps of causing the developing roller to carry a positive chargeable developer to form a thin layer of the developer, electrically charging the developer positive, and rotating the developer-carrying developing roller and the latent image-bearing drum in mutual contact or closely spaced relationship, thereby feeding the positive charged developer to the surface of the drum to visualize the electrostatic latent image on the drum surface. The roller's ionization potential is adjusted to be not lower than the developer's ionization potential.

In third and fourth aspects, the present invention provides an apparatus for developing an electrostatic latent image comprising a developing roller having a conductive layer formed around a highly conductive shaft; a rotating drum bearing an electrostatic latent image on its surface, the roller and the drum being rotatable in mutual contact or closely spaced relationship; means for causing the developing roller to carry a chargeable developer to form a thin layer of the developer; means for electrically charging the developer; and means for rotating the developer-carrying developing roller and the latent image-bearing drum, thereby feeding the charged developer to the surface of the drum to visualize the electrostatic latent image on the drum surface. In the third aspect, the developer is charged negative, and the roller's ionization potential is adjusted to be not higher than the developer's ionization potential. In the fourth aspect, the developer is charged positive, and the roller's ionization potential is adjusted to be not lower than the developer's ionization initial.

The term "ionization potential" as used herein is the energy needed to remove an electron from an atom or molecule in the ground state in a gas to an infinite distance for dissociating it into a cation and a free electron. The ionization potential of an object (developer or developing roller) can be readily determined, for example, by directly irradiating ultraviolet radiation (3.5 to 6.2 eV) to the object, and measuring the amount of photoelectrons emitted, the threshold of a power plot of its quantum efficiency giving the ionization potential.

BRIEF DESCRIPTION OF THE DRAWINGS

These and further features of the present invention will be apparent with reference to the following description and drawings, wherein.

DETAILED DESCRIPTION OF THE INVENTION

Figure 1:
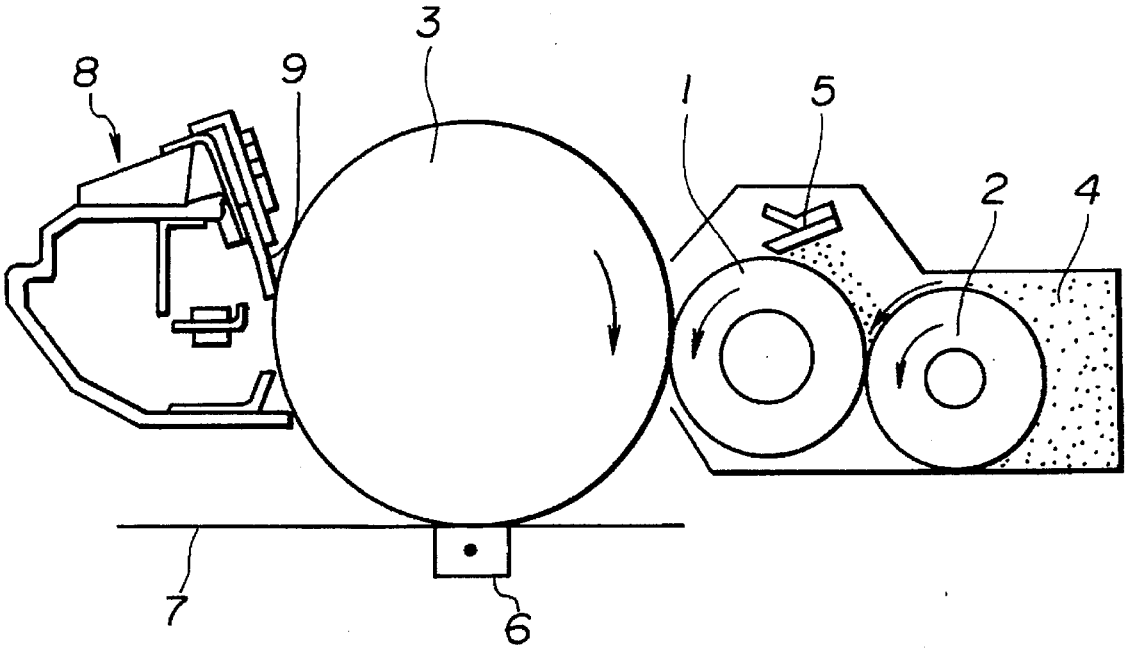
FIG. 1 schematically illustrates a developing unit according to one embodiment of the present invention.

In the method and apparatus for developing an electrostatic latent image according to the invention, the compatibility between the developer and the developing roller is controlled using the ionization potential of them at the surface as an index. The ionization potential of the developing roller surface is adjusted to be not higher than the ionization potential of the developer surface in the case of negative charging, and not lower than the ionization potential of the developer surface in the case of positive charging.

The developer used herein is preferably a one-component developer. Preferably developers have an ionization potential of 4.5 to 5.5 eV at its surface although the invention is not limited thereto. More preferably, negative chargeable developers have an ionization potential of 5.1 to 5.4 eV and positive chargeable developers have an ionization potential of 4.8 to 5.3 eV. A choice may be made among commercially available one-component developers insofar as the ionization potential fall in the desired range. It is practically difficult to increase the ionization potential of developer surface beyond 5.5 eV. Although it is possible to achieve a higher ionization potential at the initial by blending a suitable charge control agent, the ionization potential does not remain stable in most cases. If the ionization potential of developer surface is below 4.5 eV, it is difficult to set the ionization potential of a developing roller below the developer's ionization potential. Then, adequate charging of the developer would not be accomplished in the case of negative charging, and optimum control of chargeability would be difficult in the case of positive charging.

The developing roller includes a highly conductive shaft and an annular conductive layer around the shaft. Any desired shaft may be used so long as it is a good conductor. The shaft is typically a metallic shaft, for example, solid metal cores and hollow metal cylinders.

The conductive layer formed on the periphery of the shaft may be formed of a resin composition comprising a resin and a conductive powder or magnetic powder or a conductive resin when development is to be done with the latent image-bearing drum and the developing roller spaced apart (out of contact). When development is to be done with the latent image-bearing drum and the developing roller kept in contact, a relatively flexible elastomer is used as the conductive layer because of a need for a development nip. A base component of the conductive layer may be polyurethane, natural rubber, butyl rubber, nitrile rubber, polyisoprene rubber, polybutadiene rubber, silicone rubber, styrene-butadiene rubber, ethylene-propylene rubber, chloroprene rubber, acryl rubber, and mixtures thereof. Among these, polyurethene and silicone rubber are preferred in the practice of the invention. The conductive layer may be a single layer of elastomer or foam material or consist of a plurality of stacked layers. Alternatively, the base layer may be coated with a resin such as polyamides, fluoro-resins, acryl resins, polyurethane, and polycarbonate, which may contain a conductive agent. In this case, the conductive layer consists of the base layer and the coating.

As mentioned above, polyurethane is advantageously used as the base component of the conductive layer. There may be used any of polyurethane elastomers and foams which are conventionally prepared. For example, they may be prepared by blending carbon black in polyurethane prepolymer and subjecting the prepolymer to crosslinking reaction. Another known method is by blending a conductive material in a polyhydroxyl compound and reacting it with a polyisocyanate by a one-shot technique. The polyurethane is generally prepared from a polyhydroxyl compound and a polyisocyanate compound. As the polyhydroxyl compound, use may be made of polyols commonly used in the preparation of flexible polyurethane foams and urethane elastomers, such as polyether polyols terminated with a polyhydroxyl group, polyester polyols, and polyester polyether polyols obtained by copolymerizing the former two;

and other conventional polyols, for example, polyolefin polyols such as polybutadiene polyols and polyisoprene polyols, and polymer polyols obtained by polymerizing ethylenically unsaturated monomers in polyols. Examples of the polyisocyanate compound include polyisocyanates commonly used in the preparation of flexible polyurethane foams and urethane elastomers, such as tolylene diisocyanate (TDI), crude TDI, diphenylmethane-4,4'-diisocyanate (MDI), crude MDI, aliphatic polyisocyanates having 2 to 18 carbon atoms, alicyclic polyisocyanates having 4 to 15 carbon atoms, and mixtures and modified products of these polyisocyanates, e.g., prepolymers partially reacted with polyols. Particularly when development is done with the developer charged negative, it is recommended to use a polyisocyanate of the following general formula (1) in order that the ionization potential on the surface be advantageously adjusted to the above-defined range.

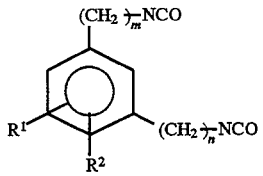

(1)

In formula (1), m and n each are an integer of 0 to 5 and $R^1$ and $R^2$ each are a hydrogen atom or alkyl group. Examples of the polyisocyanate of formula (1) are tolylene diisocyanate and xylylene diisocyanate.

In the other preferred embodiment, silicone rubber is used as the base component of the conductive layer. Organoplysiloxane raw rubbers may be used after they are conventionally crosslinked with crosslinking agents. The organoplysiloxane raw rubber used herein may be any of raw rubbers which are commonly used in molding silicone rubber compounds. Organopolysiloxanes having at least two alkenyl groups (e.g., vinyl and allyl) in a molecule are preferred. Exemplary organopolysiloxanes include both end dimethylvinylsilyl-terminated dimethylpolysiloxane, both end dimethylvinylsilyl-terminated dimethylsiloxane-methylvinylsiloxane copolymers, both end methylphenylvinylsilyl-terminated dimethylsiloxane-methylphenylsiloxane-methylvinylsiloxane copolymers, and both end dimethylvinylsilyl-terminated methyl(3,3,3-trifluoropropyl)polysiloxane.

When the conductive layer is formed from various rubber materials, crosslinking agents and vulcanizing agents may be added thereto. In either organic peroxide crosslinking or sulfur crosslinking, there may be used vulcanizing aids, vulcanization accelerators, vulcanization accelerating aids, and vulcanization retarders. In addition to these additives, there may also be used additives commonly used in rubber, for example, peptizers, blowing agents, plasticizers, softeners, tackifiers, anti-blocking agents, mold release agents, extenders, and coloring agents.

In the conductive layer based on polyurethane or silicone rubber, various charge control agents such as Nigrosine, triaminophenylmethane, and cationic dyes, and fine particulates of silicone resin, silicone rubber, and nylon may be added for the purpose of controlling the charge quantity of a one-component developer when the conductive layer is used as a part of a developing roller. Preferably about 1 to 5 parts by weight of the charge control agent and about 1 to 10 parts by weight of the fine particulates are added per 100 parts by weight of the polyurethane or silicone rubber.

Conductive agents are blended in the base rubbers to form conductive rubber compositions. Examples of the conductive powder include carbon black such as Ketjen Black EC and acetylene black; carbon for rubber such as SAF, ISAF, HAF, FEF, GPF, SRF, FT, and MT; oxidized carbon for color ink; pyrolytic carbon; natural graphite and synthetic graphite; metals and metal oxides such as antimony-doped tin oxide, titanium oxide, zinc oxide, nickel, copper, silver and germanium; and conductive polymers such as ployaniline, polypyrrole, and polyacetylene. Also, inorganic ionic conductive substances such as sodium perchlorate, lithium perchlorate, potassium perchlorate, and lithium chloride; and organic ionic conductive substances such as modified aliphatic dimethyl ammonium ethosulfate, stearyl ammonium acetate, lauryl ammonium acetate, octadecyl trimethyl ammonium perchlorate, and tetrabutyl ammonium borofluorate may be used alone or in combination with the above-mentioned powder. Preferably about 0.01 to 50 parts, more preferably about 0.1 to 30 parts by weight of the conductive agent is blended with 100 parts by weight of the base rubber component although the amount of the conductive agent blended varies with its type.

Other useful conductive agents include electron acceptors capable of forming a charge transfer complex, such as tetracyanoethylene, tetracyanoquinodimethane, benzoquinone, chloroanil, anthraquinone, anthracene, dichlorodicyanobenzoquinone, ferrocene, and phthalocyanine and derivatives thereof, which may be used alone or in admixture of two or more. Preferred among these are tetracyanoethylene and tetracyanoquinodimethane. The electron acceptors are blended in amounts of about 0.001 to 20 parts, more preferably about 0.01 to 1 parts by weight per 100 parts by weight of the polymer of the base component.

Where development is performed with the developer charged negative, it is preferred to use carbon black as the conductive agent although the invention is not limited thereto. More preferably carbon black at pH 5 or higher, especially pH 6 to 11 is used. The use of such carbon black enables to reduce the ionization potential of the conductive layer at its surface to a level lower than the ionization potential of the developer. Carbon black is desirably blended such that the conductive layer may have a resistivity of $10^3$ to $10^{10}$ Ωcm, especially $10^4$ to $10^8$ Ωcm. With a resistivity of less than $10^3$ Ωcm, there can occur leakage of electric charges to the latent image-bearing drum and breakage of the developing roller itself by voltage. With a resistivity of more than $10^{10}$ Ωcm, background fogging can occur. It is noted that the pH of carbon black is determined, for example, by boiling a carbon black sample in distilled water, centrifugally separating the mixture into a supernatant and a sludge, collecting the sludge, and measuring the sludge for pH by means of a pH meter.

In the negative charging system, lubricants and nonionic surfactants may be blended in the conductive layer of the developing roller for the purpose of adjusting the ionization potential thereof. Examples of the lubricant include monoester lubricants such as stearyl stearate and lauryl laurate and fatty acid ester lubricants such as methyl oleate and methyl palmitate. Examples of the nonionic surfactant include ester type nonionic surfactants such as polyoxyethylene monolaurate and polyoxyethylene monostearate, sorbitan ester type nonionic surfactants such as sorbitan monolaurate and sorbitan monopalmitate; and sorbitan ether ester type nonionic surfactants such as polyoxyethylene sorbitan monolaurate and polyoxyethylene sorbitan monopalmitate. By blending such lubricants and nonionic surfactants, the ionization potential of the conductive layer can be readily reduced to a level lower than the ionization potential of the developer. Preferably about 0.1 to 5 parts by weight of the lubricants and about 0.1 to 5 parts by weight of the nonionic surfactants are added per 100 parts by weight of the polymer of the base component.

Where development is performed with the developer charged positive, it is preferred to use an organic ionic conductive substance (mentioned above) rather than a conductive powder such as carbon black as the conductive agent although the invention is not limited thereto. In general, the conductive powder itself is likely to release an electron and thus has a lower ionization potential. Where such conductive powder is blended in a base resin, the resulting base resin composition will have a lower ionization potential, with which the object of the invention is not fully achievable. This tendency appears not only when conductive powder is used for controlling conductivity, but also when carbon is blended for coloring purposes. However, blending of conductive powder is acceptable if it is possible to adjust the ionization potential to fall within the desired range. The conductive layer should preferably have a resistivity of $10^5$ to $10^{10}$ Ωcm.

In either system, no particular limit is imposed on the hardness of the conductive layer. Where the developing roller is operated in contact with the latent image-bearing drum, the conductive layer on the surface should preferably have a hardness of up to 60°, more preferably 25° to 55° on JIS A hardness scale. With a hardness of more than 60°, less contact area would be available between the developing roller and the drum, failing to achieve satisfactory development. A hardness that is too low leads to an increased compression set, which means that the developing roller can be deformed or eccentric for some reason or other, resulting in images having density variations. Then, where the elastomer layer has a low hardness, its compression set should preferably be as low as possible, typically 20% or lower.

No particular limit is imposed on the surface roughness of the conductive layer and hence, the developing roller. Preferably the conductive layer has a ten point mean roughness Rz of up to 15 μm, especially 1 to 10 μm according to JIS B-0601. If the developing roller has a surface roughness Rz of more than 15 μm, a layer of the one-component developer or toner formed on the developing roller would become less uniform in thickness and charge quantity. Surface roughness Rz of up to 15 μm is effective for improving adhesion of the toner to the developing roller and preventing a lowering of image quality due to wear of the developing roller during long-term service.

The developing method and apparatus of the invention is characterized in that when development is carried out with the developer charged negative, the ionization potential of the developing roller at its surface is adjusted to be equal to or lower than the ionization potential of the developer, which is typically equal to 4.5 to 5.5 eV. When development is carried out with the developer charged positive, the ionization potential of the developing roller at its surface is adjusted to be equal to or higher than the ionization potential of the developer, which is typically equal to 4.5 to 2.5 to 5.5 eV. Preferably, the ionization potential of the developing roller at its surface is adjusted to be lower or higher than the ionization potential of the developer by about 0.1 to 0.5 eV. More specifically, the ionization potential of the developing roller at its surface is adjusted to 4.5 to 5.3 eV for the negative charging system and to 4.7 to 5.5 eV for the positive charging system. It is noted that the ionization potential can be adjusted by properly selecting a base component of the conductive layer and blending therein a properly selected type and amount of additives such as conductive agent, lubricant, and surfactant.

As previously mentioned, the ionization potential of a conductive layer can be readily determined, for example, by forming a sheet sample of the same composition as the conductive layer, directly irradiating ultraviolet radiation (3.5 to 6.2 eV) to the sample, and measuring the amount of photoelectrons emitted. The threshold of a power plot of its quantum efficiency gives the ionization potential. The instrument used in this measurement may be a commercially available surface analyzer such as AC-1M of Riken Keiki K.K.

By adjusting the ionization potential of the developer and the developing roller at their surface as mentioned above, the developing method and apparatus of the invention is successful in producing images of quality without fogging and image memory. The occurrence of image fogging and image memory is effectively prevented by the invention for the following reason.

Figure 2:
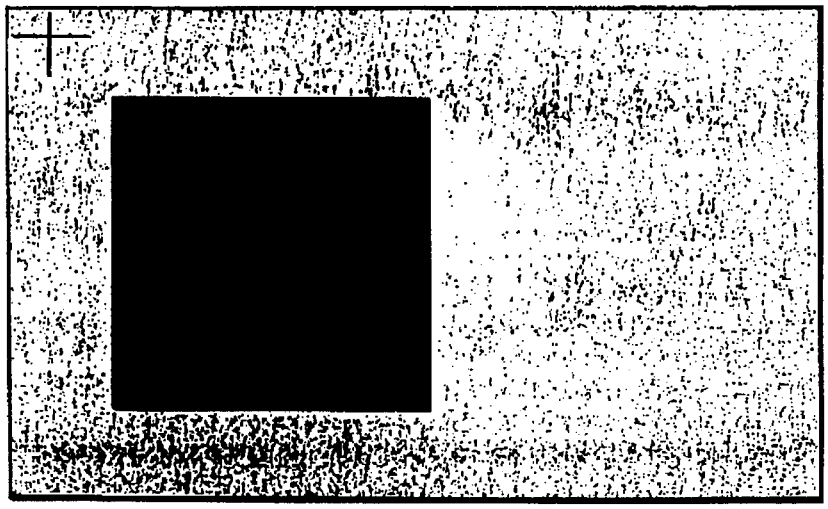
FIG. 2 illustrates a fogged image.

The image fogging is a phenomenon that grains appear in an area which should be a white image area as shown in FIG. 2. Fog is caused by the presence of a weakly or oppositely charged developer. It is noted that the "ionization potential" to be adjusted herein is the energy needed to remove an electron from an atom or molecule in the ground state in a gas to an infinite distance for dissociating it into a cation and a free electron as previously mentioned. In the negative charging system where development is carried out with the developer charged negative, if the developing roller has a lower ionization potential at the surface, then electron transfer will readily take place from the developing roller surface to the developer carried on the developing roller surface and having a higher ionization potential, ensuring that the developer be charged negative to a high potential. On the other hand, in the positive charging system where development is carried out with the developer charged positive, if the developing roller has a higher ionization potential at the surface, then electron transfer will readily take place from the developer carried on the developing roller surface and having a lower ionization potential to the developing roller surface, ensuring that the developer be charged positive to a high potential. Consequently, the occurrence of a weakly or oppositely charged developer is prevented in either the negative or positive charging system, ensuring to produce images of quality.

The image memory is prevented for the following reason. For example, when an image partially containing a black area and a halftone area adjacent thereto is printed, the developer on the area of the developing roller corresponding to the black area is almost fully consumed. In a subsequent cycle, that area of the developing roller receives a new feed of the developer. If the developer has a slow rise of charging, the charge quantity becomes uneven between that area of the developing roller corresponding to the black area and the remaining area. Then the hysteresis of the black area can be left on the halftone area. This phenomenon is generally known as image memory. To avoid the occurrence of image memory, the developer must have a quick rise of charging. The control of ionization potential according to the invention is effective to this end too.

The developing method and apparatus of the invention are generally designed to develop an electrostatic latent image by causing the developing roller to carry a developer to form a thin layer of the developer and rotating the developer-carrying developing roller and the latent image-bearing drum in mutual contact or closely spaced relationship, thereby feeding the developer to the surface of the drum to visualize the electrostatic latent image on the drum surface. This can be embodied with the mechanism shown in FIG. 1. Although the developing roller 1 and the latent image-bearing drum 3 are in contact in the embodiment of FIG. 1, development can be carried out while keeping the developing roller 1 and the latent image-bearing drum 3 in a closely spaced or non-contact relationship.

EXAMPLE

Examples of the present invention are given below by way of illustration and not by way of limitation. All parts are by weight.

Example 1

To 100 parts of polyether polyol obtained by adding propylene oxide and ethylene oxide to glycerin so as to give a molecular weight of 5,000 and an OH value of 33 (Exenol® 828, Asahi Glass K.K.) were added 1.0 part of 1,4-butane diol, 1.5 parts of a silicone surfactant (L-520, Nihon Unicar K.K.), 0.5 part of nickel acetylacetonate, 0.01 part of dibutyltin dilaurate, and 1.0 part of acetylene black at pH 6.9 (Denka K.K.). The ingredients were mixed in a mixer and then milled in a paint roll until the acetylene black was uniformly dispersed, obtaining a polyol composition.

The polyol composition was agitated under vacuum for debubbling and 17.5 parts of urethane-modified MDI (Sumidur® PF, Sumitomo Bayer Urethane K.K.) was added thereto. The resulting composition was agitated for 2 minutes and cast into a mold preheated at 110° C. the mold having a metal shaft placed therein. It was then heated for curing at 110° C. for 2 hours to form a conductive layer around the shaft, obtaining a roller. The roller was surface ground to a ten point mean roughness Rz of 7 μm, completing a developing roller.

Separately, a sheet sample was prepared from the same composition as the conductive layer. The sheet sample was measured to have an ionization potential of 5.0 eV.

The roller was mounted in the developing unit shown in FIG. 1 as the developing roller 1. The photoconductor drum 3 was an organic photoconductor drum for negative charging. The toner 4 was a toner for a printer CP500 manufactured by Casio K.K. (ionization potential 5.3 eV). Development was carried out under conditions: photoconductor charging potential −820 V, developing bias −400 V, and linear velocity 60 mm/sec. Measurement of toner charge quantity and image evaluation were carried out as will be described later. The results are shown in Table 1.

Example 2

Development was carried out as in Example 1 except that a toner for a printer PC-PR1000E/4 manufactured by NEC (ionization potential 5.1 eV) was used. Measurement of toner charge quantity and image evaluation were carried out. The results are also shown in Table 1.

Example 3

To 100 parts of polyisoprene polyol having a molecular weight of 2,500 and an OH value of 47.1 were added 2 parts of a monoester type lubricant Unistar M9676 (Nihon Usi K.K.) and 3.32 parts of acetylene black. The ingredients were agitated for 30 minutes. Then 13.33 parts of crude MDI (NCO=31.7%) and 0.001 part of dibutyitin dilaurate were added to the mixture, which was agitated for 3 minutes. The reactive composition was cast into a mold preheated at 90° C., the mold having a metal shaft placed therein. It was then heated for curing at 90° C. for 12 hours to form a conductive layer around the shaft, obtaining a roller. The roller was surface ground to a ten point mean roughness Rz of 7 μm, completing a developing roller.

Separately, a sheet sample was prepared from the same composition as the conductive layer. The sheet sample was measured to have an ionization potential of 5.0 eV.

Using the developing roller, development was carried out as in Example 1. Measurement of toner charge quantity and image evaluation were carried out. The results are also shown in Table 1.

Example 4

A developing roller was prepared as in Example 1 except that 0.01 part of sodium perchlorate and 8.3 parts of tolylene diisocyanate were used instead of the acetylene black and urethane-modified MDI, respectively. A similarly prepared sheet sample had an ionization potential of 5.1 eV.

Using the developing roller, development was carried out as in Example 1. Measurement of toner charge quantity and image evaluation were carried out. The results are also shown in Table 1.

Example 5

The developing roller prepared in Example 1 was surface treated by immersing it in a 10 wt % toluene solution of a fluoro-resin (fluoro-olefin vinyl ether copolymer), pulling up, and heat drying. The developing roller as treated was similarly measured for ionization potential, finding a potential of 5.0 eV.

Using the surface treated developing roller, development was carried out as in Example 1. Measurement of toner charge quantity and image evaluation were carried out. The results are also shown in Table 1.

Example 6

A mixture of 100 parts of polytetramethylene ether glycol having an OH value of 56 and 1.0 part of sodium perchlorate was agitated at a controlled temperature of 100° C. To the mixture was added 13.48 parts of 4,4'-diphenylmethane diisocyanate (NCO=33.6%). The mixture was agitated and mixed. The reactive composition was cast into a mold preheated at 90° C., the mold having a metal shaft placed therein. It was then heated for curing at 90° C. for 12 hours to form a conductive layer around the shaft, obtaining a roller. The roller was surface ground to a ten point mean roughness Rz of 5 μm, completing a developing roller.

Separately, a sheet sample was prepared from the same composition as the conductive layer. The sheet sample was measured to have an ionization potential of 5.5 eV.

The roller was mounted in the developing unit shown in FIG. 1 as the developing roller 1. The photoconductor drum 3 was an organic photoconductor drum for positive charging. The toner 4 was a styrene-acryl system toner (ionization potential 4.9 eV). Development was carried out under conditions: photoconductor charging potential +750 V, developing bias −350 V, and linear velocity 60 mm/sec. Measurement of toner charge quantity and image evaluation were similarly carried out. The results are also shown in Table 1.

Comparative Example 1

A developing roller was prepared as in Example 1 except that 0.01 part of sodium perchlorate was used instead of the acetylene black. A similarly prepared sheet sample had an ionization potential of 5.4 eV.

Using the developing roller, development was carried out as in Example 1. Measurement of toner charge quantity and image evaluation were carried out. The results are also shown in Table 1.

Comparative Example 2

Development was carried out as in Example 6 except that the development roller of Example 1 (ionization potential 5.0 eV) and a polyester toner (ionization potential 5.3 eV) were used. Measurement of toner charge quantity and image evaluation were carried out. The results are also shown in Table 1.

Measurement of toner charging quantity

A roller was mounted in the developing unit of FIG. 1 as the developing roller. While the developing roller was rotated at a circumferential speed of 50 mm/sec., a uniform thin layer of toner was formed on its surface. The toner layer was pneumatically sucked into a Faraday gage for measuring an electric charge quantity.

Image reproduction

Images were reproduced through reversal development mounting a roller in the developing unit of FIG. 1 as the developing roller and rotating it at a circumferential speed of 50 mm/sec. The images were examined for fog and sharpness.

Image memory was evaluated under a hot humid environment at 33° C. and RH 85% using an image chart consisting of an end portion of solid black and a succeeding portion of half tone.

TABLE 1

| | Toner charge (μC/g) | | Image rating | | | Ionization potential (ev) | |
|---|---|---|---|---|---|---|---|
| | N/N | H/H | Fog | Sharp-ness | Image memory (H/H) | Roller | Toner |
| E1 | −8.2 | −7.0 | nil | good | nil | 5.0 | 5.3 |
| E2 | −7.2 | −6.6 | nil | good | nil | 5.0 | 5.1 |
| E3 | −8.5 | −7.0 | nil | good | nil | 5.0 | 5.3 |
| E4 | −7.0 | −5.8 | nil | good | nil | 5.1 | 5.3 |
| E5 | −9.5 | −7.5 | nil | good | nil | 5.0 | 5.3 |
| E6 | +10.5 | +8.5 | nil | good | nil | 5.5 | 4.9 |
| CE1 | −4.6 | −2.7 | fogged | thickened | occurred | 5.4 | 5.3 |
| CE2 | +4.5 | +2.0 | fogged | thickened | occurred | 5.0 | 5.3 |

The method and apparatus for developing an electrostatic latent image according to the invention ensure easy control of the compatibility between the toner and the developing roller and reproduction of satisfactory images without defects such as fog and image memory.

We claim:

1. An apparatus for developing an electrostatic latent image comprising a developing roller having a conductive layer formed around a highly conductive shaft and a rotating drum bearing an electrostatic latent image on its surface, the roller and the drum being rotatable in mutual contact or closely spaced relationship, means for causing the developing roller to carry a positive chargeable developer to form a thin layer of the developer, means for electrically charging the developer positive, and means for rotating the developer-carrying developing roller and the latent image-bearing drum, thereby feeding the positive charged developer to the surface of the drum to visualize the electrostatic latent image on the drum surface, the developing roller on its surface having an ionization potential and the developer on its surface having an ionization potential, the roller's ionization potential being adjusted to be not lower than the developer's ionization potential.

2. The apparatus of claim 1 wherein the ionization potential of the developer is 4.5 to 5.5 eV.

3. An apparatus for developing an electrostatic latent image comprising a developing roller having a conductive layer formed around a highly conductive shaft and a rotating drum bearing an electrostatic latent image on its surface, the roller and the drum being rotatable in mutual contact or closely spaced relationship, means for causing the developing roller to carry a negative chargeable developer to form a thin layer of the developer, means for electrically charging the developer negative, and means for rotating the developer-carrying developing roller and the latent image-bearing drum, thereby feeding the negative charged developer to the surface of the drum to visualize the electrostatic latent image on the drum surface, the developing roller on its surface having an ionization potential and the developer on its surface having an ionization potential, the roller's ionization potential being adjusted to be not higher than the developer's ionization potential, said conductive layer of the developing roller contains at least one lubricant selected from monoester lubricants and fatty acid ester lubricants and/or at least one nonionic surfactant selected from ester type, sorbitan ester type, and sorbitan ether ester type nonionic surfactants.

4. The apparatus of claim 3 wherein the ionization potential of the developer is 4.5 to 5.5 eV.

5. The apparatus of claim 3 wherein the conductive layer of the developing roller contains carbon black of at least pH 5.

6. An apparatus for developing an electrostatic latent image comprising a developing roller having a conductive layer formed around a highly conductive shaft and a rotating drum bearing an electrostatic latent image on its surface, the roller and the drum being rotatable in mutual contact or closely spaced relationship, means for causing the developing roller to carry a negative chargeable developer to form a thin layer of the developer, means for electrically-charging the developer negative, and means for rotating the developer-carrying developing roller and the latent image-bearing drum, thereby feeding the negative charged developer to the surface of the drum to visualize the electrostatic latent image on the drum surface, the developing roller on its surface having an ionization potential and the developer on its surface having an ionization potential, the roller's ionization potential being adjusted to be not higher than the developer's ionization potential, at least an outer most lamina of the conductive layer of the developing roller is based on a polyurethane elastomer or foam comprising a polyisocyanate of the following general formula:

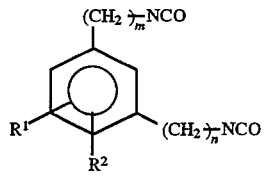

wherein m and n each are an integer of 0 to 5 and $R^1$ and $R^2$ each are a hydrogen atom or alkyl group.

7. The apparatus of claim 6 wherein the ionization potential of the developer is 4.5 to 5.5 eV.

8. The apparatus of claim 6 wherein the conductive layer of the developing roller contains carbon black of at least pH 5.

* * * * *